US005510043A

United States Patent [19]

Inoue

[11] Patent Number: 5,510,043

[45] Date of Patent: Apr. 23, 1996

[54] LUBRICATING OIL ADDITIVE COMPRISING SULFURIZED MONOALKYLCATECHOL AND ITS DERIVATIVES

[75] Inventor: Kiyoshi Inoue, Yokohama, Japan

[73] Assignee: Nippon Oil Co., Ltd. Central Technical Research Laboratory, Yokohama, Japan

[21] Appl. No.: 243,821

[22] Filed: May 17, 1994

Related U.S. Application Data

[63] Continuation-in-part of Ser. No. 32,882, Mar. 18, 1993, abandoned.

[30] Foreign Application Priority Data

Mar. 23, 1992 [JP] Japan ..... 4-94967

[51] Int. Cl.[6] ..... C10M 135/02

[52] U.S. Cl. ..... 252/42.7; 252/48.2

[58] Field of Search ..... 252/42.7, 48.2, 252/48.4; 568/23, 48, 763, 796

[56] References Cited

U.S. PATENT DOCUMENTS 4,115,287 9/1978 Colclough et al. ..... 252/48.2

4,221,673 9/1980 Robson et al. ..... 252/42.7

*Primary Examiner*—Prince Willis, Jr.
*Assistant Examiner*—Cephia D. Toomer
*Attorney, Agent, or Firm*—Bucknam and Archer

[57] ABSTRACT

A lubricating oil additive comprising an alkaline earth metal salt of a sulfurized monoalkylcatechol as a main component represented by the following general formula (I):

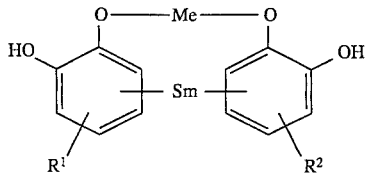

(I)

wherein Me represents an alkaline earth metal, $R^1$ and $R^2$ represent each an alkyl group having 14 to 30 carbon atoms, m is a number of from 1 to 2, which provides a lubricating oil additive excellent in anti-oxidant, friction-reducing and anti-abrasive properties at high temperature.

2 Claims, No Drawings

LUBRICATING OIL ADDITIVE COMPRISING SULFURIZED MONOALKYLCATECHOL AND ITS DERIVATIVES

This application is a continuation-in-part of U.S. Ser. No. 08/032,882 filed Mar. 18, 1993, now abandoned.

BACKGROUND OF THE INVENTION

1. Field of the Invention

The present invention relates to a lubricating oil additive comprising an alkaline earth metal salt of a sulfurized monoalkylcatechol as a main component, and more particularly to a lubricating oil additive, particularly a lubricating oil additive for an internal combustion engine which is excellent in anti-oxidant, friction-reducing and anti-abrasive properties and comprises a lubricating oil additive comprising an alkaline earth metal salt of a sulfurized monoalkylcatechol as a main component, and a process for producing the same. The present invention also relates to a lubricating oil composition comprising said lubricating oil additive.

2. Prior Art

In recent years, a remarkable lowering in fuel consumption and an increase in output have been made on internal combustion engines. This requires lubricating oils to have a capability of lowering the abrasion and oxidation stability and detergency at high temperature.

The function of monoalkylcatechols as an antioxidant and an abrasion inhibitor of lubricating oils and as a deposit inhibitor of diesel engines is described in U.S. Pat. No. 4,643,838. Further, U.S. Pat. No. 4,729,848 describes that metal salts of monoalkyl catechol dithiophosphoric acids are useful as an anti-wear agent of lubricating oils for gasoline and diesel engines. The monoalkylcatechols, however, have a problem in the anti-oxidant property at high temperature. Further, since the metal salts of monoalkyl catechol dithiophosphoric acids contain phosphorus poisonous to exhaust gas purification catalysts, the use thereof should be limited by more severe regulation of exhaust gas in the future.

U.S. Pat. No. 4,221,673 reports that a lubricating oil additive having an excellent rust preventive property can be produced by adding 10 to 50% by weight of an alkyldihydroxybenzene in the production of a sulfurized or nonsulfurized phenate. This patent, however, reports that the viscosity of the formed overbased sulfurized phenate increases with increasing the amount of addition of nonylcatechol and, when the amount of the nonylcatechol is 100%, the lubricating oil additive solidifies by the addition of calcium hydroxide. In the production of the nonsulfurized phenate, the product is a physical mixture of an alkylphenol with an alkyldihydroxybenzene, while in the production of the sulfurized phenate, the product is a compound comprising an alkylphenol and an alkyldihydroxybenzene bonded to said alkylphenol through sulfur crosslinking. Thus this patent does not take into consideration the use of the alkylcatechol or sulfurized alkylcatechol as such.

U.S. Pat. No. 4,115,287 describes a lubricating oil composition comprising a sulfurized dihydroxy benzene having an alkyl group of at least 7 carbon atoms and also reports that the composition has an excellent rust preventive property and excellent stability against oxidation. The compounds disclosed in this patent, however, have a problem in the friction-reducing properties, anti-abrasive properties and colour stability.

SUMMARY OF THE INVENTION

An object of the present invention is to provide a lubricating oil additive excellent in anti-oxidant, friction-reducing and anti-abrasive properties at high temperature and a process for producing the same. A further object of the present invention is to provide a lubricating oil composition comprising said lubricating oil additive.

The present inventors have made studies on the increase in the performance of monoalkylcatechols and, as a result, have found that a lubricating oil additive comprising an alkaline earth metal salt of a sulfurized monoalkylcatechol as a main component has very excellent anti-oxidant, friction-reducing and anti-abrasive properties at high temperature, which has led to the completion of the present invention.

Thus the lubricating oil additive of the present invention is characterized by comprising an alkaline earth metal salt of a sulfurized monoalkylcatechol as a main component represented by the following general formula (I):

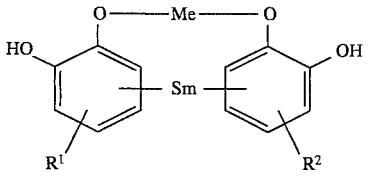

(I)

wherein Me represents an alkaline earth metal, $R^1$ and $R^2$ represent each an alkyl group having 14 to 30 carbon atoms, m is a number of from 1 to 2.

DETAILED EXPLANATION OF THE INVENTION

The present invention will now be explained hereunder in more detail.

The sulfurized monoalkylcatechol to be used as a raw material of the lubricating oil additive in the present invention is usually produced by sulfurizing an alkylation product of a catechol. The alkylation product of a catechol is usually produced by reacting a catechol with an olefin in the presence of a catalyst. The olefin usable herein is preferably one having 14 to 30 carbon atoms, and specific examples thereof include α-olefins such as 1-tetradecene, 1-pentadecene, 1-hexadecene, 1-heptadecene, 1-octadecene, 1-nonadecene, 1-eicosene, 1-heneicosene and 1-docosene; oligomers of olefin having 3 to 5 carbon atoms, such as propylene pentamer and butene tetramer; or mixtures of two or more of them. The catalyst to be used may be any conventional alkylation catalyst, and examples thereof include acid catalysts such as iron chloride and ion exchange resins. The reaction temperature is usually 50° to 200° C., preferably 100° to 150° C. Examples of an alkyl group of the monoalkylcatechol include an alkyl group derived from olefin mentioned above and mixtures thereof. The substitution position of the alkyl group is preferable in ortho or para position and may be mixtures of these ortho or para substituted compounds.

The sulfurized monoalkylcatechol is usually produced by reacting the above-described alkylcatechol with sulfur or sulfur chloride. In this case, although the amount of the sulfur or sulfur chloride may be arbitrary, it is preferable to conduct the reaction in the presence of sulfur as sulfur atom or sulfur chloride in an amount of 0.5 to 2.0, preferably 0.5 to 1 molecular proportion based on 1 molecular proportion of said monoalkylcatechol used at the time of the reaction for the purpose of obtaining said sulfurized monoalkylcatechol. When sulfur is used, the reaction temperature is usually 100° to 250° C., preferably 150° to 200° C. The reaction time is usually 2 to 6 hours. When sulfur chloride is used, the reaction temperature is usually 0° to 30° C., preferably 10° to 20° C. The reaction time is usually 4 to 8 hours. Examples of the sulfurized monoalkylcatechols include compounds represented by the following general formula (II):

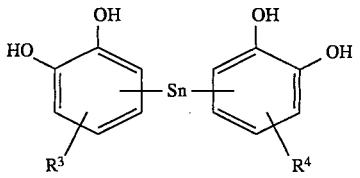

(II)

wherein $R^3$ and $R^4$ may be identical with, or different from, each other, respectively, and represent each an alkyl group derived from said olefin having 14 to 30 carbon atoms, preferably 14 to 18 carbon atoms and n is a number of from 1 to 2, preferably 1.3 to 1.7. The substitution position of the alkyl group is preferable in ortho or para position.

The lubricating oil additive comprising an alkaline earth metal salt of a sulfurized monoalkylcatechol as a main component in the present invention are produced by reacting a sulfurized monoalkylcatechol with an alkaline earth metal hydroxide or oxide. Specific examples of the alkaline earth metal hydroxide or oxide include magnesium hydroxide, calcium hydroxide, barium hydroxide, magnesium oxide, calcium oxide and barium oxide.

In this case, an alkanol having 1 to 4 carbon atoms is preferably added in an amount of 5 to 30% by weight based on the sulfurized monoalkylcatechol because this accelerates the reaction. The alkanol having 1 to 4 carbon atoms is preferably a monoalkanol or dialkanol, and specific examples thereof include methanol, ethanol, propanol, butanol, ethylene glycol, propylene glycol, triethylene glycol, butylene glycol, tetramethylene glycol and mixtures thereof.

Further, a diluting solvent may be added in an amount of 50 to 200% by weight based on the sulfurized monoalkylcatechol, and generally a nonpolar organic solvent having a boiling point of 60° C. or above is usable. Specific examples thereof include aromatic hydrocarbons, such as benzene, toluene and xylene, solvents derived from petroleum, such as benzine, ligroin, mineral spirit and cleaning solvent, and gasoline fraction, kerosene traction, gas oil fraction and lubricating oil fraction of mineral oils.

Although the reaction conditions may be arbitrary, the reaction is preferably conducted at a temperature of 100° to 200° C., preferably 130° to 160° C. for 2 to 8 hours, preferably 3 to 5 hours.

Further, according to a preferred embodiment of the present invention, an alkaline earth metal hydroxide or oxide may also be present during the sulfurization reaction to simultaneously conduct the sulfurization of the monoalkylcatechol and the formation of the alkaline earth metal salt. The lubricating oil additive comprising an alkaline earth metal salt of a sulfurized monoalkylcatechol as a main component can be obtained by the one-step reaction by simultaneously conducting the reaction of (a) a monoalkylcatechol, (b) sulfur or sulfur chloride and (c) an alkaline earth metal hydroxide or oxide. In this reaction, although the amount of the sulfur or sulfur chloride may be arbitrary, it is preferable to conduct the reaction in the presence of sulfur as sulfur atom or sulfur chloride in an amount of 0.5 to 2.0, preferably 0.5 to 1 molecular proportion based on 1 molecular proportion of said monoalkylcatechol. In this case, it is a matter of course that the above-described alkanol having 1 to 4 carbon atoms and diluting solvent may be present. In this case as well, the reaction conditions may be arbitrary, but the reaction is preferably conducted at a temperature of 100° to 200° C., preferably 130° to 150° C. for 2 to 8 hours, preferably 3 to 5 hours.

The thus produced lubricating oil additive of the present invention comprises an alkaline earth metal salt of a sulfurized monoalkylcatechol as a main component represented by the following general formula (I):

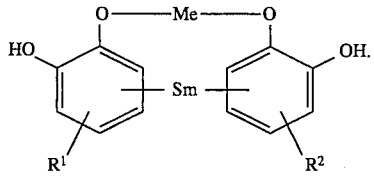

(I)

In this general formula (I), although Me represents an alkaline earth metal such as beryllium, magnesium, calcium, strontium and barium, among them the alkaline earth metal is preferably magnesium, calcium and barium, more preferably calcium. $R^1$ and $R^2$ may be identical with, or different from, each other, respectively, and represent each an alkyl group derived from said olefin having 14 to 30 carbon atoms, preferably 14 to 18 carbon atoms, and m is a number of from 1 to 2, preferably 1.3 to 1.7.

In any of the above-described embodiments, that is, the process for reacting a sulfurized monoalkylcatechol with an alkaline earth metal hydroxide or oxide, or the process for simultaneously reacting a monoalkylcatechol with sulfur or sulfur chloride in the presence of an alkaline earth metal hydroxide or oxide, the amount of the alkaline earth metal hydroxide or oxide is important. When all the sulfurized monoalkylcatechol in the lubricating oil additive to be produced is reacted with the alkaline earth metal, the product results in solidification. From this point of view, although the lubricating oil additive of the present invention comprises an alkaline earth metal salt of a sulfurized monoalkylcatechol as a main component represented by the above general formula (I), it is preferable that the sulfurized monoalkylcatechol reacted without the alkaline earth metal salt is contained in an amount of 2 to 70 parts by weight, preferably 2 to 30, more preferably 2 to 10 parts by weight in the lubricating oil additive. For the purpose of result, in a case where the reaction of the sulfurized monoalkylcatechol with the alkaline earth metal hydroxide or oxide is carried out, it is preferable to conduct the reaction of the sulfurized monoalkylcatechol with the alkaline earth metal hydroxide or oxide in an amount of 0.1 to 0.5, preferably 0.3 to 0.49 molecular proportion of based on 1 molecular proportion of said monoalkylcatechol used at the time of the reaction of said sulfurized monoalkylcatechol. Further, in a case where the reaction of (a) a monoalkylcatechol, (b) sulfur or sulfur chloride and (c) an alkaline earth metal hydroxide or oxide is simultaneously carried out, it is preferable to conduct the reaction by using the alkaline earth metal hydroxide or oxide in an amount of 0.1 to 0.5, preferably 0.3 to 0.49 molecular proportion based on 1 molecular proportion of said monoalkylcatechol. When the alkaline earth metal hydroxide or oxide is also present during the sulfurization reaction of the monoalkylcatechol, the amounts of the alkanol having 1 to 4 carbon atoms and the diluting solvent are calculated on the assumption that the sulfurized monoalkylcatechol has been once produced.

Thereafter, the alkanol and/or the diluting solvent may be removed by distillation according to need.

Thus the lubricating oil additive comprising an alkaline earth metal salt of a sulfurized monoalkylcatechol as a main component can be prepared. If necessary, they may be further purified by various means such as filtration for the purpose of removing unreacted starting compound, by-products, etc.

Since the lubricating oil additives comprising an alkaline earth metal salt of a sulfurized monoalkylcatechol as a main component according to the present invention have excellent anti-oxidant, friction-reducing and anti-abrasive properties, they can be used as a lubricating oil additive without any treatment or after dilution with a suitable solvent. Specifically, the lubricating oil additive comprising an alkaline earth metal salt of a sulfurized monoalkylcatechol as a main component may be incorporated into base oils to prepare lubricating oil compositions.

The base oil to be used in the present invention is not particularly limited and may be any oil generally used as a base oil for lubricating oils. Examples of mineral oils usable as the base oil include paraffinic and naphthenic oils prepared by subjecting crude oil to atmospheric distillation and vacuum distillation and purifying the lubricating oil fraction through a suitable combination of purification treatments such as solvent deasphalting, solvent extraction, hydrocracking, solvent dewaxing, catalytic dewaxing, hydrorefining, sulfuric acid treating and clay treating. Examples of synthetic oils usable as the base oil include poly-α-olefins such as polybutene, 1-octene oligomer and 1-decene oligomer; alkylbenzenes; alkylnaphthalenes; diesters such as ditridecyl glutarate, di-2-ethylhexyl adipate, diisodecyl adipate, ditridecyl adipate and di-2-ethylhexyl sebacate; polyol esters such as trimethylolpropane caprylate, trimethylolpropane pelargonate, pentaerythritol 2-ethylhexanoate and pentaerythritol pelargonate; polyoxyalkylene glycol; polyphenyl ether; and perfluoroalkyl ether. These base oils may be used alone or in a combination of two or more of them.

When the lubricating oil additives comprising an alkaline earth metal salt of a sulfurized monoalkylcatechol as a main component according to the present invention are used as a lubricating oil composition after they are incorporated into a base oil for a lubricating oil, the content thereof is each 0.01 to 10% by weight, preferably 0.1 to 5% by weight based on the whole composition.

The lubricating oil composition of the present invention can be used as a gasoline engine oil, a diesel engine oil, a hydraulic oil, a gear oil, an automatic transmission fluid, etc. It may be used in combination with conventional lubricating oil additives, such as metallic detergent additives, ashless dispersants, extreme-pressure agents, agents for reducing friction, rust preventives, corrosion inhibitors, antifoaming agents, pour point depressants, viscosity index improvers and anti-oxidants, according to the applications and performances required of the lubricating oils.

PREFERRED EMBODIMENTS OF THE PRESENT INVENTION

The present invention will now be described in more detail with reference to the following Examples and, however, it is not limited to these Examples.

Synthesis Example 1 (Production of alkylcatechol)

550 g (5 mol) of catechol and 80 g of Amberlyst 15 as an alkylation catalyst were placed in a 3-l four-necked round-bottomed flask. The flask was heated to 120° C. to melt the contents of the flask. 1,232 g (5.5 mol) of a mixture comprising 1-tetradecene, 1-hexadecene and 1-octadecene in respective amounts of 40% by weight 40% by weight and 20% by weight were placed in a dropping bottle and dropwise added to the flask in a nitrogen stream over a period of 3 hours. Thereafter, the reaction was allowed to proceed for 2 hours while maintaining the system at 120° C. After the completion of the reaction, the catalyst was removed by filtration. The filtrate was transferred to a three-necked flask, and unreacted catechol and hexadecene were removed by distillation under reduced pressure. Thereafter, a fraction having a boiling point in the range of 225° to 235° C. under a pressure of 1 mmHg was obtained as a product. $^{13}$C-NMR spectroscopy revealed that the product comprised 55% of 1-alkylcatechol, 40% of 2-alkylcatechol and 5% of dialkylcatechol.

Synthesis Example 2

(Production 1 of sulfurized monoalkylcatechol)

167 g (0.5 mol) of the alkylcatechol produced in the Synthesis Example 1 and 12.8 g (0.4 mol) of sulfur were placed in a 500-ml four-necked flask and reaction was allowed to proceed at 195° C. for 4 hours. After the completion of the reaction, the reaction mixture was filtered through a 0.45-μm Millipore filter by using Celite as a filter aid. The resultant sulfurized monoalkylcatechol had a sulfur content of 2.73% (calculated value: 2.74%).

Synthesis Example 3

(Production 2 of sulfurized monoalkylcatechol)

167 g (0.5 mol) of the alkylcatechol produced in the Synthesis Example 1 and 5.15 g (0.5 mol) of sulfur dichloride were placed in a 500-ml four-necked flask and reaction was allowed to proceed at 20° C. for 4 hours while dropwise adding the reagent. After completion of the dropwise addition of the reagent, the reaction was allowed to proceed additionally for one hour. After completion of the reaction, the reaction mixture was filtered through a 0.45-μm Millipore filter by using Celite as filter aid. The resultant sulfurized monoalkylcatechol had a sulfur content of 8.8% (calculated value: 8.9%).

Example 1

(Production 1 of Calcium salt of sulfurized monoalkylcatechol)

90 g of the sulfurized monoalkylcatechol synthesized in the Synthesis Example 2, 9 g of calcium hydroxide, 25 g of ethylene glycol and 90 g of a diluting oil (100 neutral oil) were placed in a 500-ml four-necked flask and reaction was allowed to proceed at 120° C. for 4 hours. Thereafter, ethylene glycol was removed by distillation at 195° C. for one hour. The residue was filtered under reduced pressure by using Celite as a filter aid to provide a calcium salt of the sulfurized monoalkylcatechol. The calcium salt of the monoalkylcatechol had a Ca content of 2.7% (calculated value: 2.7%) and n base number (JIS K 2501) of 74.6.

Example 2

(Production 2 of calcium salt of sulfurized monoalkylcatechol)

90 g of the sulfurized monoalkylcatechol synthesized in the Synthesis Example 3, 9 g of calcium hydroxide, 25 g of ethylene glycol and 90 g of a diluting oil (100 neutral oil) were place in a 500-ml four-necked flask and reaction was allowed to proceed at 120° C. for 4 hours. Thereafter, ethylene glycol was removed by distillation at 195° C. for one hour. The residue was filtered under reduced pressure by using Celite as a filter aid to provide a calcium salt of the sulfurized monoalkylcatechol. The calcium salt of the monoalkylcatechol had a Ca content of 2.6% (calculated value: 2.7%) and a base number (JIS K 2501) of 64.9.

Example 3

(Production 3 of calcium salt of sulfurized monoalkylcatechol)

65.6 g of the monoalkylcatechol synthesized in the Synthesis Example 1, 7.4 g of calcium hydroxide, 6.4 g of sulfur, 16 g of ethylene glycol and 76 g of a diluting oil (100 neutral oil) were placed in a 300-ml four-necked flask and reaction was allowed to proceed at 155° C. for 4 hours. Thereafter, ethylene glycol was removed by distillation at 195° C. for one hour. The residue was filtered under reduced pressure by using Celite as a filter aid to provide a calcium salt of the sulfurized monoalkylcatechol. The calcium salt of the monoalkylcatechol had a Ca content of 2.4% (calculated value: 2.7%) and a base number (JIS K 2501) of 74.1.

Examples 4 and Comparative Examples 1 to 6

Lubricating oil compositions containing the lubricating oil additive comprising an alkaline earth metal salt of a sulfurized monoalkylcatechol as a main component produced in Example 2 were subjected to the evaluation of abrasion resistance by the high-speed four-ball test. The results are given in Table 1. In the table, for comparison, data on a base oil alone, a lubricating oil composition containing the monoalkylcatechol (Synthesis Example 1) and lubricating oil compositions respectively containing commercially available calcium salt of a sulfurized alkylphenate and sulfurized alkylphenol and the sulfurized monoalkylcatechol produced in the Synthesis Examples 2 and 3 are also given in the table. The base oil was a hydrorefined mineral oil of SAE10, and the content of various additives (compounds) therein was 2% by weight.

Effect of the Invention

As described above, lubricating oil compositions excellent in abrasion resistance at high temperature can be produced by incorporating as a lubricating oil additive the lubricating oil additive comprising an alkaline earth metal salt of a sulfurized monoalkylcatechol as a main component, to a base oil for a lubricating oil.

TABLE 1

| Ex. | Compd. incorporated into base oil | Abrasion track diam. (mm) |
|---|---|---|
| Comp. Ex. 1 | SAE10 base oil alone | 0.73 |
| Comp. Ex. 5 | sulfurized monoalkylcatechol (Synthesis Ex. 2) | 0.54 |
| Comp. Ex. 6 | sulfurized monoalkylcatechol (Synthesis Ex. 3) | 0.54 |
| Ex. 4 | Ca salt of sulfurized monoalkylcatechol (Ex. 2) | 0.40 |

TABLE 1-continued

| Ex. | Compd. incorporated into base oil | Abrasion track diam. (mm) |
|---|---|---|
| Comp. Ex. 2 | monoalkylcatechol (Synthesis Ex. 1) | 0.60 |
| Comp. Ex. 3 | commercially available Ca sulfurized alkylphenate | 0.40 |
| Comp. Ex. 4 | commercially available sulfurized alkylphenol | 0.76 |

Testing conditions: load of 30 kg, number of revolutions of 1200 rpm., temp. at 80° C., time for 30 min.

What is claimed is:

1. A lubricating oil additive consisting of (A) 100 parts by weight of an alkaline earth metal salt of a sulfurized monoalkylcatechol of formula (I):

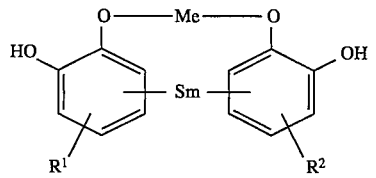

(I)

wherein Me is an alkaline earth metal each of $R^1$ and $R^2$ is an alkyl group having 14 to 30 carbon atoms, m is a number from 1 to 2; and;

(B) 2–70 parts by weight of a sulfurized monoalkylcatechol of formula (II):

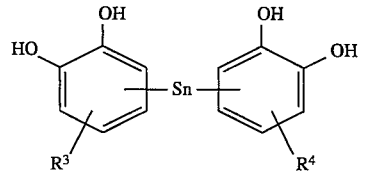

(II)

wherein each of $R^3$ and $R^4$ is an alkyl group having 14 to 30 carbon atoms, and n is a number from 1 to 2.

2. The additive according to claim 1 wherein the amount of said sulfurized monoalkylcatechol (B) is 2–10 parts by weight.

* * * * *